United States Patent [19]

Blümle

[11] Patent Number: 4,671,152

[45] Date of Patent: Jun. 9, 1987

[54] APPARATUS FOR CUTTING OUT WINDOWS IN ENVELOPES

[75] Inventor: Martin Blümle, Horhausen, Fed. Rep. of Germany

[73] Assignee: Winkler & Duennebier Maschinenfabrik und Eisengiesserei GmbH & Co KG, Neuwied, Fed. Rep. of Germany

[21] Appl. No.: 730,544

[22] Filed: May 6, 1985

[30] Foreign Application Priority Data

May 11, 1984 [DE] Fed. Rep. of Germany ..... 3417536

[51] Int. Cl.[4] ..... B31B 19/14; B31B 21/14; B26F 1/38

[52] U.S. Cl. ..... 83/152; 83/100; 83/24; 83/165; 83/911

[58] Field of Search ..... 83/13, 24, 37, 27, 98–100, 83/152, 165, 439, 443, 673, 911

[56] References Cited

U.S. PATENT DOCUMENTS

| | | | |
|---|---|---|---|
| 3,103,842 | 9/1963 | Winkler et al. | 83/152 X |
| 3,106,121 | 10/1963 | Novick | 83/152 |
| 3,172,321 | 3/1965 | Schrader | 83/911 X |
| 3,186,274 | 6/1965 | Winkler et al. | 83/152 X |
| 3,527,127 | 9/1970 | Stovall | 83/911 X |
| 3,548,696 | 12/1970 | Hornung | 83/152 X |
| 3,611,855 | 10/1971 | Thousand | 83/100 |

*Primary Examiner*—Donald R. Schran
*Attorney, Agent, or Firm*—W. G. Fasse; D. H. Kane, Jr.

[57] ABSTRACT

Windows are cut into envelopes and bags, in a machine with a feed device having transport rollers for cut-out envelope blanks or for a web, a cutting roller, a tool cooperating with the cutting roller and at least one suction roller for further transport, are arranged in a window cutting station of the machine. The envelope material is moved along a straight line tangentially to the point of cutting out the windows and is then further conveyed in the peripheral direction of the cutting roller. The blanks with the windows cut therein and the cut-out waste are separately grasped by suction and removed.

6 Claims, 3 Drawing Figures

APPARATUS FOR CUTTING OUT WINDOWS IN ENVELOPES

FIELD OF THE INVENTION

The invention relates to a method and an apparatus for cutting out windows in envelopes and bags, in which a feed device having transport rollers for cut out envelope blanks, a cutting roller, a tool cooperating with the cutting roller and at least one suction roll for further transport are arranged in a window cutting station of an envelope or bag making machine.

DESCRIPTION OF THE PRIOR ART

In known apparatus of the sort relevant here the blanks as the case may be, are either supplied tangentially to the cutting roller and tangentially removed therefrom, or they are fed along a curved path to the point of cutting and then removed from the cutting location. Both methods have their own shortcomings. In the first case the cut-out blank may be moved out of position since the sheet or blank lying flat, is in a condition of unstable equilibrium, in other words, it is not securely held in place.

Another frequent cause of machine failure that is more specially likely with windows placed far to the outside, and which happens when the part of the blank in front of a window in the direction of motion is sucked together with waste.

If the material is to be supplied and removed along a curved path the construction of the rollers is complex, since the knife has to be mounted on the transport roller in such a way that it may slide. The production of such roller is therefore expensive and furthermore the range of variation in the position of the window is limited because of the need for a leading suction rail. Furthermore, lateral displacement of the window opening is not possible during travel. Lastly, such machines as a rule are equipped with three vacuum rollers, this leading to a high power requirement and to very noisy operation.

SUMMARY OF THE INVENTION

Consequently one object of the present invention is to devise a method of cutting out windows in envelopes and to provide a window cutting station for this purpose whereby it is possible to operate with a high degree of freedom from machine malfunctions.

A further aim of the invention is to devise such a machine which operates satisfactorily whatever the setting of the cutting roller for producing windows in any desired position on the blank.

Yet a further objective of the invention is to make possible an adjustment while the machine is running.

In order to effect these and further objects, in accordance with the invention the cut out blank is transported tangentially to the point of cutting and further transported thence in the peripheral direction and in that then the cut-out blank and the waste produced by the window cutting, are aspirated by suction to hold them.

Therefore, in accordance with the invention, there is a flat inlet with pushing transport roller, the cutting taking place at the end of the straight feed operation. The leading end of the blank will then already be in the form of an arc and is therefore stabilized and positively guided. This feature assures a neat acceptance or take-up by means of vacuum at the next roller and there are no problems in connection with the discharge of the window cut-out or waste into a conventional hopper. The result is a neat and positive separation of the window cutout from the blank.

Further features of the invention are set forth in the claims and described with reference to the drawings.

Figure 1:
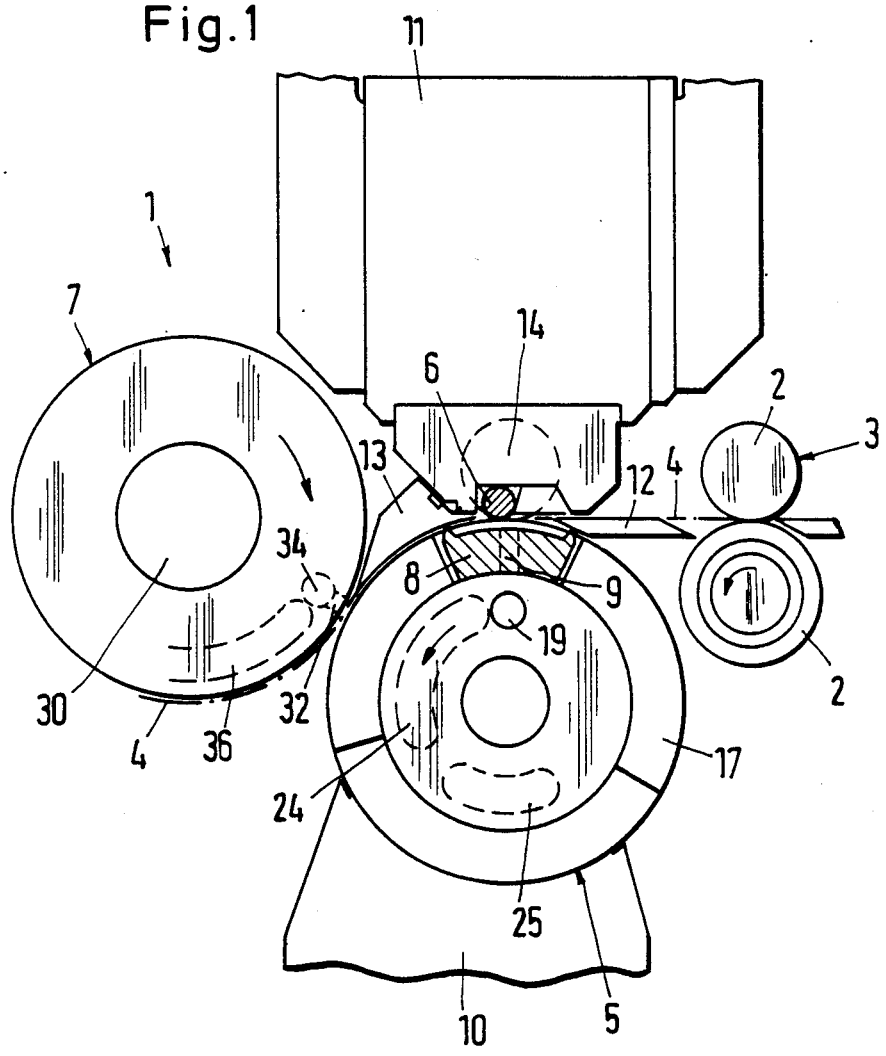
FIG. 1 is a diagrammatic view of the apparatus for cutting out windows from envelope material.

DETAILED DESCRIPTION OF PREFERRED EXAMPLE EMBODIMENTS AND OF THE BEST MODE OF THE INVENTION

The window cutting station 1 or apparatus for cutting out windows in envelopes and bags forms part of an envelope and bag making machine, comprises a material feed device 3 having transport roller 2 for the cut-out material blanks 4. The station 1 further includes a cutting roller 5 and a hold-down tool 6 for cooperation with the cutting roller and at least one suction roller or drum for further transporting of the envelopes. The cutting roller or drum 5 has a cutting tool 8 able to be adjusted in a generally known way, such tool 8 having at least one suction hole 9 for the window waste and an aspiration funnel 10 or hopper. The cooperating tool 6 is in the form of a bar of ceramic material, or a four-edged bar (not shown) clamped in the upper part 11 of the machine. The tool 6 may, alternately take the form of a cooperating roller or a cooperating knife.

As will be seen from FIG. 1, the cut out blanks 4 as the case may be, are transported to the point of cutting at the cooperating tool 6 and thence moved in the circumferential direction of the cutting roller 5. Furthermore, the cut-out blanks 4 or the web and the window waste are cleared or taken up by suction. Thus, the cut-out waste is taken up by suction right at the cutting tool 8, while the suction roller 7 provides suction for the cut blank or blanks 4.

An important point in connection with the guidance of the blanks 4 is the fact that they are linearly guided to the point of cutting at the cutting tool 8 and the cooperating tool 6 and are then further transported along an arcuate path away from this position.

For the guidance of the blanks 4 there is a tangentially placed guide plate 12 at the cutter inlet and a guide member 13 pointing in the circumferential direction, is located at the output side of the cutting roller 5. Spring loaded transport roller 14, driven by friction are located on the two sides of and adjacent to the cooperating tool 6.

Figure 2:
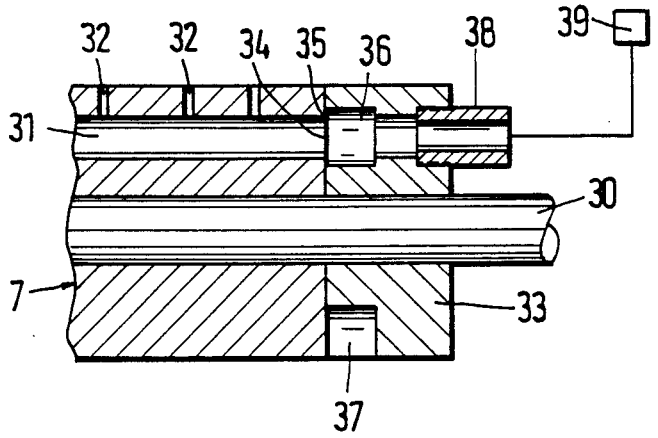
FIG. 2 is a broken away section through the suction roller.
Figure 3:
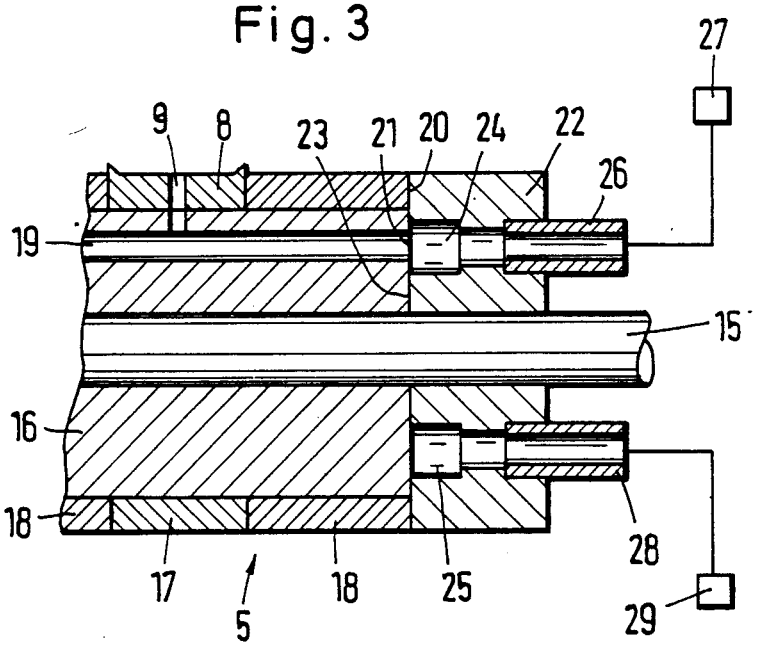
FIG. 3 is a broken away section through the cutting roller.

The form and operation of the cutting roller 5 having a suction hole 9 and of the suction roller 7 are generally known and are therefore only described briefly with reference to FIGS. 2 and 3.

The cutting roller 5 is supported between side frames (not shown) so that it may be rotated together with its shaft 15. The shaft 5 has a cylindrical core 16 see FIG. 3, on which the cutting tool 8, spacer segments 17 and distance rings 18 are placed like a shell. A longitudinal hole 19 in the core 16 communicates with the suction hole or holes 9 in the cutting tool 8. The longitudinal hole 19 extends from the cutting tool or tools 8 distributed along the length of the cutting roller 5, to one end face 20 of the cutting roller 5 and ends at a timing port 21 in a timing head 22 located at the end face 20 of the cutting roller 5. The timing head is stationary. A timing duct 24 for vacuum and a timing duct 25 by compressed air are located near the end face 23 of the head 22 facing the cutting roller 5. The timing duct 24 is connected to a vacuum producing pump 27 or the like by a duct 26. One line 28 runs from the timing duct 25 to a pressure producing device 29.

The position of the two timing ducts 24 and 25 is marked by dashed lines in FIG. 1. As soon as the timing port 21 at the end of the longitudinal hole 19 of the cutting roller 5 runs in front of the timing duct 24, there will be vacuum in the longitudinal hole 19. However, the vacuum is replaced by gage pressure as soon as the timing port 21 arrives at the timing duct 25 in the timing head 22. As long as there is vacuum a piece of waste for example produced by cutting out a window will be sucked up and on reaching a position over the suction hopper 10, the waste will be blown off.

The construction and operation of the suction device of the suction roller 7 are generally similar. The suction roller 7 is mounted for rotation on, or with, its shaft 30 between side walls not shown. It has a longitudinal hole 31, several suction holes 32, and a timing head 33 placed at the end. In its end face 35 turned towards the timing port 34 the timing head 33 has a timing duct 36 for vacuum and a duct 37 for atmospheric pressure equalization. The timing duct 36 communicates through a duct 38 with a vacuum pump 39 or the like, whereas the duct 37 on the periphery of the timing head 33 communicates directly with the atmosphere.

Each time the timing port 34 of the suction roller 7 moves past the timing duct 36, the suction holes 32 will be connected through the longitudinal hole 31, the timing duct 36, and the duct 38 with the vacuum pump 39. Therefore, the suction holes 32 will hold a sheet. When, upon further rotation, the timing port 34 moves past the duct 37, the suction holes 32 have air let into them and the sheet will be released.

The position of the timing duct 36 in the timing head 33 is marked in dashed lines in FIG. 1. Furthermore FIG. 1 shows the timing port 34 in the suction roller 7 right before arriving at the timing duct 36, that is to say, at a point in time before suction takes effect at the periphery of the suction roller 7.

For each working stroke it will be seen that the cutting roller 5 and the suction roller 7 turn through one revolution.

I claim:

1. An apparatus for cutting windows into flat blank material to form cut blanks and window waste, comprising a rotary cutting roller (5) rotatable in a given direction, said cutting roller comprising cutting means (8) on its surface and suction port means (9) opening within said cutting means on said cutting roller surface for holding said window waste, feed-in means (2, 3) for transporting said flat blank material (4) to a cutting location on said cutting roller (5), said feed-in means including horizontal first guide means (12) for guiding flat blank material tangentially onto said cutting roller (5), hold down means (6) in said cutting location for cooperation with said cutting means (8), circumferential second guide means (13) arranged downstream of said cutting location as viewed in said given direction for circumferentially guiding said cut blank and the window waste on said cutting roller (5), a discharge suction drum (7) arranged for cooperation with said cutting roller downstream of said circumferential guide means to transfer a cut blank from said cutting roller to said suction drum, and suction control means (24, 25; 36, 37) arranged for cooperation with said cutting roller and with said suction drum for applying suction to said window waste in said cutting location through said suction port means (9) and for applying suction to said cut blank through said suction drum downstream of said circumferential guide means, whereby said window waste is separated from said cut blank only after said cut blank is firmly held by said suction drum.

2. The apparatus of claim 1, wherein said suction drum (7) is arranged relative to said circumferential guide means in such a position that suction is applied to a leading edge of said cut blank as said cut blank emerges from a gap formed between said cutting roller (5) and said circumferential guide means (13).

3. The apparatus of claim 1, further comprising transport roller means (14), said hold-down means comprising a hold-down roller (6) extending in parallel to said cutting roller, said transport roller means (14) being arranged adjacent to ends of said hold-down roller (6).

4. The apparatus of claim 1, wherein said feed-in means comprise transport roller means (2, 3) arranged upstream of said cutting location as viewed in a feed-in direction for pushing said flat blank material into said cutting location along said first guide means.

5. The apparatus of claim 1, wherein said feed-in means are adapted for transporting said flat blank material as individual blanks.

6. The apparatus of claim 1, wherein said feed-in means are adapted for transporting said flat blank material as a continuous web.

* * * * *